US008829793B2

(12) United States Patent
Beau et al.

(10) Patent No.: US 8,829,793 B2
(45) Date of Patent: Sep. 9, 2014

(54) HIGH PRESSURE DISCHARGE LAMP

(75) Inventors: Michael Beau, Berlin (DE); Yan Ming Li, Cambridge, MA (US); Thomas Schroeder, Wipperfuerth (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 930 days.

(21) Appl. No.: 12/502,260

(22) Filed: Jul. 14, 2009

(65) Prior Publication Data

US 2010/0007275 A1 Jan. 14, 2010

(30) Foreign Application Priority Data

Jul. 14, 2008 (DE) ..... 20 2008 009 456 U

(51) Int. Cl.

| | |
|---|---|
| ***H01J 61/30*** | (2006.01) |
| ***H01J 61/34*** | (2006.01) |
| ***H01J 5/48*** | (2006.01) |
| ***H01J 61/54*** | (2006.01) |
| ***H01J 61/82*** | (2006.01) |
| ***H01J 61/10*** | (2006.01) |

(52) U.S. Cl.

CPC ..... *H01J 61/10* (2013.01); *H01J 61/34* (2013.01); *H01J 5/48* (2013.01); *H01J 61/547* (2013.01); *H01J 61/827* (2013.01)

USPC ..... 313/634; 313/635; 313/243

(58) Field of Classification Search

CPC ..... H01J 5/48

USPC ..... 313/634–635, 243, 623–625, 493, 313/318.02, 570, 578; 118/50; 445/26, 27

See application file for complete search history.

(56) References Cited

U.S. PATENT DOCUMENTS

| | | | | |
|---|---|---|---|---|
| 4,401,913 | A * | 8/1983 | Koza et al. | 313/25 |
| 4,507,584 | A * | 3/1985 | Coaton et al. | 313/624 |
| 4,709,184 | A * | 11/1987 | Keeffe et al. | 313/638 |
| 6,054,810 | A * | 4/2000 | Yamamoto et al. | 313/607 |
| 6,844,676 | B2 | 1/2005 | Alderman et al. | |
| 2002/0163315 | A1 * | 11/2002 | Kaneko et al. | 315/246 |
| 2003/0025455 | A1 | 2/2003 | Alderman et al. | |
| 2005/0104500 | A1 | 5/2005 | Haverlag et al. | |
| 2008/0093993 | A1 * | 4/2008 | Tu | 313/642 |

FOREIGN PATENT DOCUMENTS

| | | | |
|---|---|---|---|
| EP | 1494261 | A2 | 1/2005 |
| WO | 03030209 | A1 | 4/2003 |
| WO | 03060948 | | 7/2003 |
| WO | 2007129232 | A2 | 11/2007 |

* cited by examiner

*Primary Examiner* — Elmito Breval

(57) ABSTRACT

In various embodiments, a high pressure discharge lamp is provided. The high pressure discharge lamp may include a lamp axis, and a two-ended discharge vessel that surrounds a discharge volume, electrodes extending into the discharge volume enveloped by the discharge vessel, and a fill that includes metal halides being accommodated in the discharge volume, the discharge vessel being surrounded by an outer bulb with a base at one end and being held therein by a frame, wherein the frame comprises a short supply lead and a long supply lead, the long supply lead comprising two straight conductors with a winding part therebetween, the winding part executing at most 1.25 turns about the discharge vessel.

12 Claims, 7 Drawing Sheets

HIGH PRESSURE DISCHARGE LAMP

RELATED APPLICATIONS

The present application claims priority from German application No.: 20 2008 009 456.9 filed on Jul. 14, 2008.

TECHNICAL FIELD

Various embodiments relate to a high pressure discharge lamp. Such lamps are high pressure discharge lamps with a ceramic discharge vessel, in particular for general lighting.

BACKGROUND

WO 03/030209 discloses a high pressure discharge lamp in the case of which a ceramic discharge vessel is held in an outer bulb by means of a frame, the discharge vessel having two ends, and the outer bulb having a base at one end. In this case, the frame is guided around the discharge vessel in a plurality of turns in order to compensate the arc curvature.

However, such a design requires both material outlay and expensive production.

SUMMARY

In various embodiments, a high pressure discharge lamp includes a lamp axis and a two-ended discharge vessel that surrounds a discharge volume, electrodes extending into the discharge volume enveloped by the discharge vessel, and a fill that includes metal halides being accommodated in the discharge volume, the discharge vessel being surrounded by an outer bulb with a base at one end and being held therein by a frame, wherein the frame includes a short supply lead and a long supply lead, the long supply lead including two straight conductors with a winding part therebetween, the winding part executing at most 1.25 turns about the discharge vessel.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, logical, and electrical changes may be made without departing from the scope of the invention. The various embodiments are not necessarily mutually exclusive, as some embodiments can be combined with one or more other embodiments to form new embodiments.

The word "exemplary" is used herein to mean "serving as an example, instance, or illustration". Any embodiment or design described herein as "exemplary" is not necessarily to be construed as preferred or advantageous over other embodiments or designs.

Figure 1:
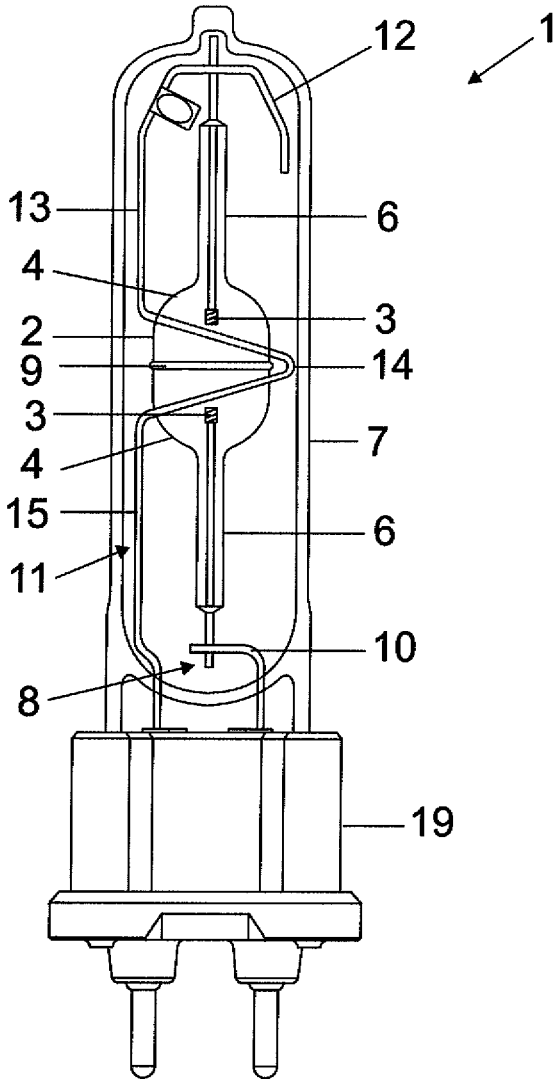
FIG. 1 shows a high pressure discharge lamp with discharge vessel.

FIG. 1 is a schematic of a metal halide lamp 1. It includes a discharge vessel 2 made from ceramic into which two electrodes 3 are introduced. The discharge vessel has a central cylindrical part 5 and two rounded ends 4 that are e.g. designed as hemispherical shells. Seated at the ends are two seals 6 that are designed here as capillaries. The discharge vessel and the seals are preferably produced integrally from two halves made from a material such as PCA. The connecting bead has the reference numeral 9. The discharge vessel 2 is surrounded by an outer bulb 7. The discharge vessel 2 is held in the outer bulb by means of a frame 8. The outer bulb is sealed by means of a base part 19.

The frame includes a short supply lead 10 for the end of the discharge vessel pointing toward the base, and a long supply lead, the return path 11, for the end of the discharge vessel averted from the base. The return path 11 has a bracket part 12 and a remote straight part 13 that points from the bracket in the direction of the base, a winding part 14 that is arranged in the region of the central part of the discharge vessel, and a straight part 15 arranged adjacent to the base. The straight parts extend from the capillary into the zone that lies between the end of the discharge volume and the tip of the electrode 3.

The discharge vessel is a hemispherical shell with the radius R of the half shell at the end parts 4, while the straight cylindrical section 5 has the axial length L between the half shells, and the electrode spacing is EA.

Figure 2:
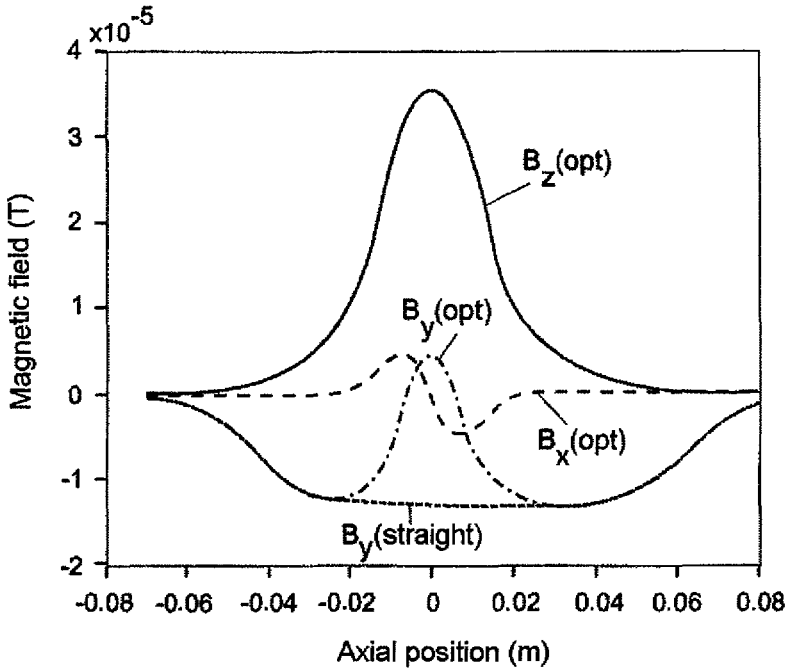
FIG. 2 shows an illustration of the magnetic field as a function of the axial position.

The diagram shown in FIG. 2 shows the magnetic field B (in teslas) on the y-component By (perpendicular to the connecting line between the electrodes) of the straight supply lead (By straight) and three field components Bx, By, Bz of the optimum magnetic field B(opt) of an optimum winding part. In this case, Bz(opt) points along the connecting line between the electrodes, and effects no deflection of the arc. Bx(opt) changes sign in the region of the plasma arc and thus also does not lead to an extensive arc curvature. By(opt) vanishes approximately in the middle of the arc.

Figure 3:
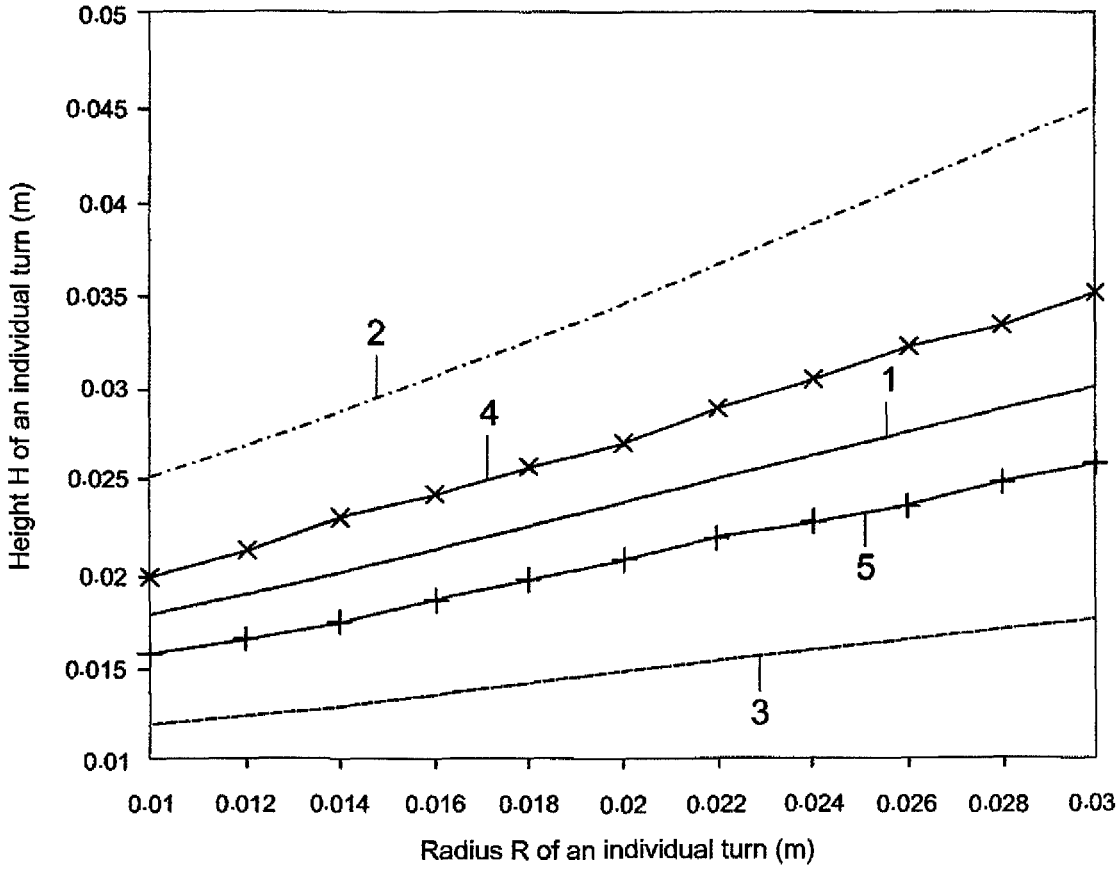
FIG. 3 shows an illustration of the height of the winding as a function of the radius of the winding.

FIG. 3 shows the optimum height H (axial length in meters) of the winding part (where the integral of By along the electrode spacing vanishes) as a function of the radius R of the winding part. Specified in addition are the heights H in the case of which the magnetic field of a straight conductor is reduced to 10% or 30%. What is involved is a winding part with a complete turn. Curve 1 is valid for an average magnetic field B of B=0. Curve 2 shows the relationships for a mean magnetic field of B=0.3 Bw. Here, Bw is the magnetic field that is produced in the case of a straight return part without winding, when the current strength is 1 A in conjunction with the specified radius R. Curve 3 shows the relationships for an average magnetic field of B=−0.3 Bw. Curve 4 shows the relationships for an average magnetic field of B=0.1 Bw, and curve 5 the relationships for an average magnetic field of B=−0.1 Bw.

Figure 4:
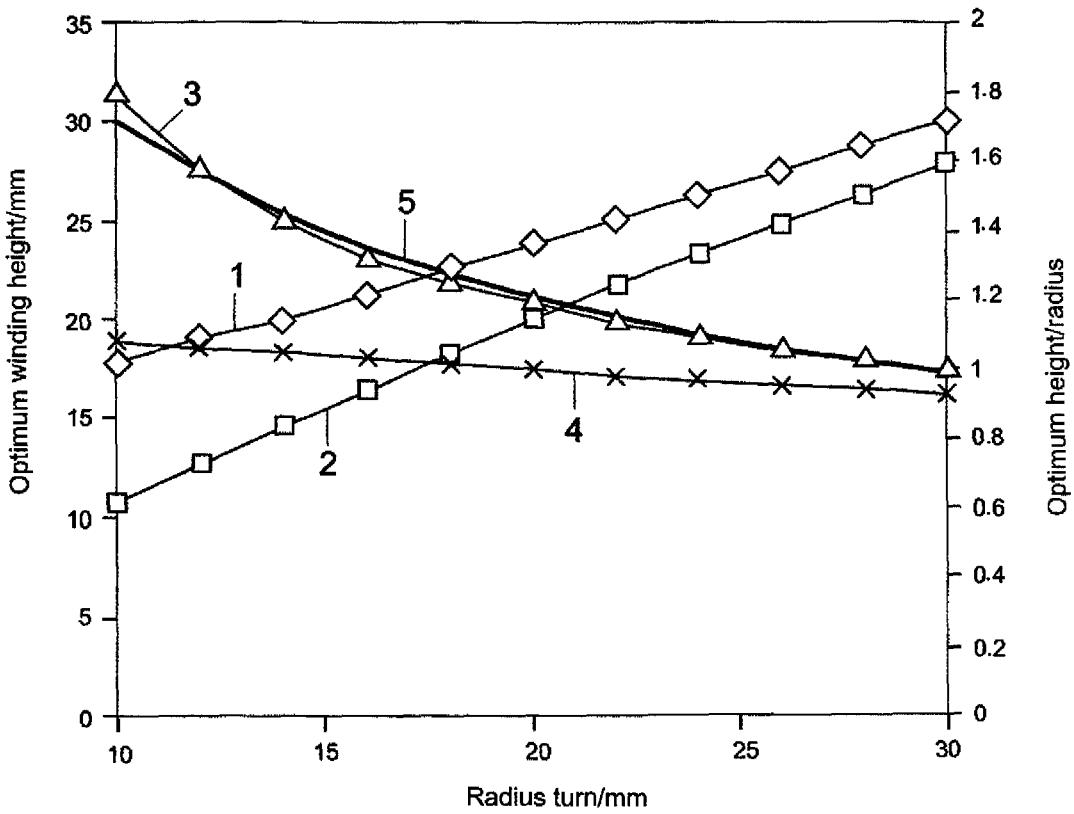
FIG. 4 shows an illustration of the optimum winding height as a function of the radius of the winding.

FIG. 4 shows on the left hand ordinate the optimum height H of the filament By(opt)—that is to say where the integral of By vanishes overall along the electrode spacing, curve 1—and By0(opt)—it being assumed that the magnetic field vanishes in the middle between the electrodes, curve 2—as a function of the radius R of the winding part, compare FIG. 3 to this. Both heights of the winding part are also illustrated in a fashion normalized in the radius as H/R, see right hand ordinate to this end. The normalization of the curve 1 results in curve 3, while the normalization of curve 2 results in curve 4. By way of comparison, curve 5 is the closed illustration of the power curve $y=5.64\ x^{-0.514}$ ($R^2=0.989$).

A concrete example of the relation between winding height H and electrode spacing EA is H=20 mm and EA=18 mm. It is e.g. the case that H=1.0 to 1.3 EA.

Figure 5:
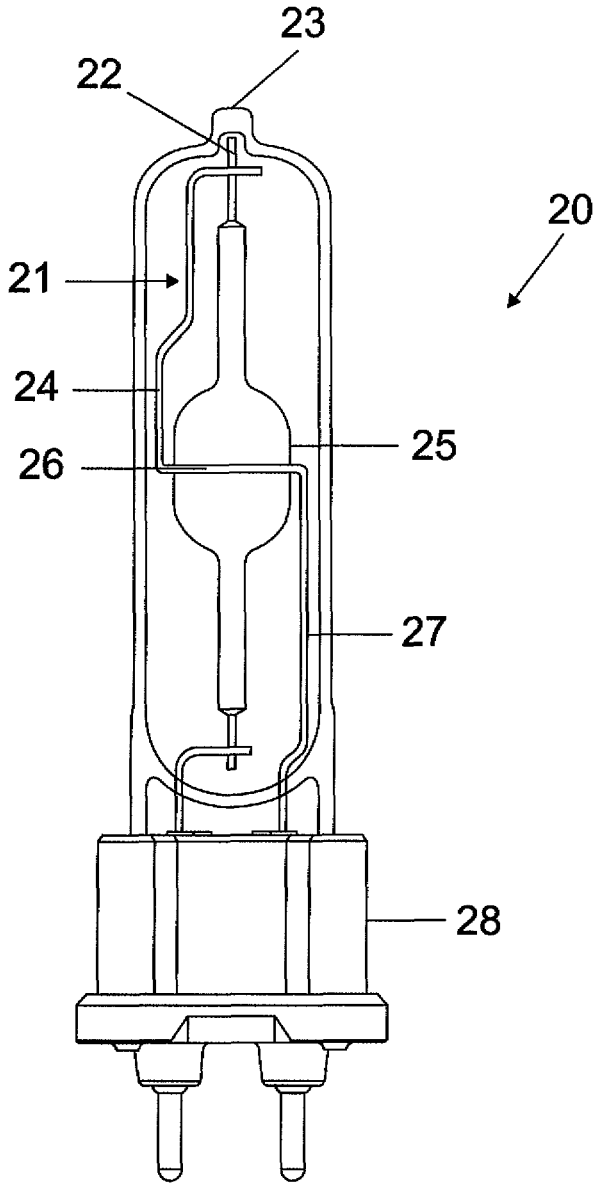
FIG. 5 shows a further exemplary embodiment of a high pressure discharge lamp.

FIG. 5 shows an exemplary embodiment of a metal halide lamp 20 in the case of which the return path 21 is cranked. The bracket part is depicted only in an elementary way, because the remote supply lead 22, which exits from the discharge vessel, is held in a tip 23. From the end straight conductor part 24, which reaches here up to the middle of the discharge vessel 25, a semicircle 26 is drawn as winding part to the opposite side of the discharge vessel. From there, the adjacent straight conductor part 27 is guided into the base 28.

Figure 6:
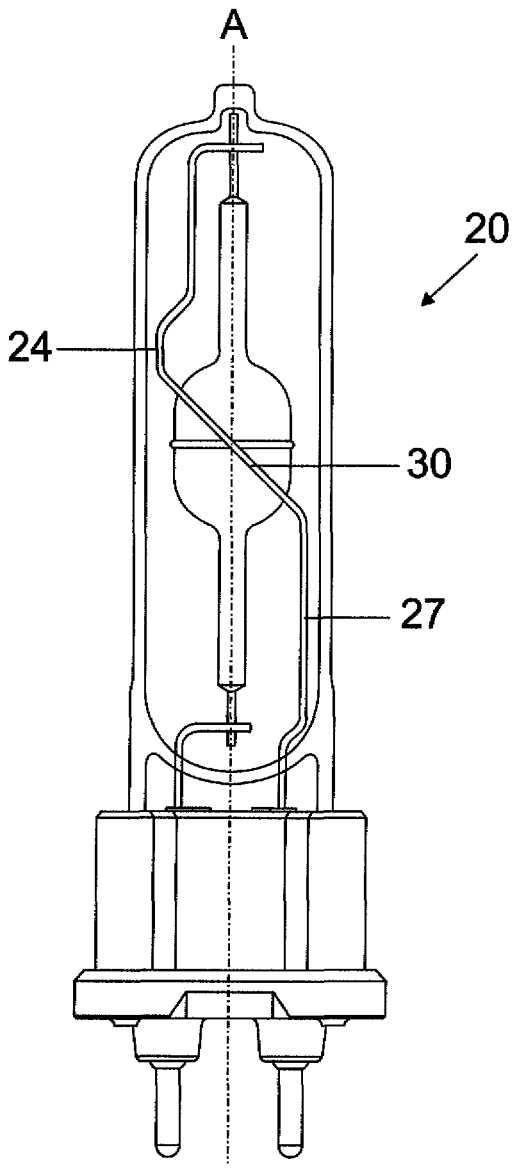
FIG. 6 shows a further exemplary embodiment of a high pressure discharge lamp.

FIG. 6 shows a further exemplary embodiment of a metal halide lamp 20 in the case of which the winding part 30 likewise executes only a half turn. However, this half turn is not carried out in a plane transverse to the lamp axis, but in a plane that is inclined obliquely to the lamp axis A, for example at an angle of 30° to 45°. The straight conductor parts 24, 27 in the discharge volume respectively end here approximately at the height of the tips of the electrodes.

A typical fill includes the following components:

Hg: 10 to 40 mg;

Xe or Ar, respectively 120 to 380 mbar;

NaI 0 to 10% by weight;

TlI PEI 5 to 20% by weight;

SEJ3: SE=Dy+Ho+Tm, overall 20 to 50% by weight;

CeI3: 0 to 10% by weight.

The winding part may include at most 1.25 turns about the discharge vessel, and at least 0.25 turns. It may e.g. include 0.5 to 1.0 turns.

Table 1 shows the mean values of the photoelectric data and standard deviations of voltage and color location of various specimens given an operating time of approximately 100 h. The meanings are here as follows:

R wire: return wire;

position: v: vertical, h: horizontal (supply lead below);

ul: lamp voltage;

uls: restarting peak;

pl: lamp power;

Φ: light flux;

η: light yield;

tn: color temperature;

dc: distance from the Planck curve;

Ra: color rendering;

R9: color rendering saturated red;

σ(G): standard deviation of the variable G.

The discharge vessel is e.g. ceramic, but it can also be fabricated from silica glass.

It holds for the axial length H and the radius R of the winding part that: $0 \leq H/R \leq 3.0$ and e.g. $\leq 2.5$.

Various embodiments provide a metal halide high pressure discharge lamp for general lighting with the aid of which the positional dependence of color location, light flux and light yield is minimized as much as possible, and the mean service life is lengthened.

In various embodiments, the metal halide lamp uses a frame with a return wire that has straight portions and at most 1.25 turns. This may simplify the mounting, may minimize the material costs, may lead to only a slight additional shading (of the order of magnitude of only 1%) and may stabilize the discharge vessel additionally in the outer bulb. A higher light yield can thereby be attained. The color location of the lamp is now virtually independent of the operating position. The service life is also increased. 0.5 and 1.0 turns are particularly suitable in terms of production engineering.

Problems with the service life of ceramic metal halide lamps with a base at one end occur owing to the arc curvature in a horizontal orientation. The object here is to achieve a universal operating position. The plasma arc in the discharge vessel has so far very closely approached the wall of the discharge vessel in the case of a horizontal operating position, and leads to overheating and, in the final analysis, to breakage of the ceramic. This is caused inter alia by the position of the straight return wire below the discharge vessel. In this case, the arc interacts with the magnetic field caused by the current of the return wire and effects a repulsion of the arc. The natural arc curvature is thereby intensified by the "buoyancy" of the hot plasma.

It is known that the magnetic force on the arc can be compensated by a second return wire, see WO 03/030209 A1. However, such a design requires a considerable extra outlay on material and process steps, and is capable of being automated only with a high outlay. Two further designs shown there are the double helix and a filament with a plurality of turns.

WO 03/060948 describes a coil perpendicular to the burner axis. Here, as well, the arrangements are very complicated and expensive to mount. Furthermore, many lines in the vicinity of the burner absorb light and thus reduce light flux and light yield. US 2003/025455 describes a curved return wire. The solo result of this is to increase the spacing from the arc, and the magnetic field is thereby only slightly reduced. Furthermore, there is no room for such a design in a case of narrow outer bulbs.

Figure 7:
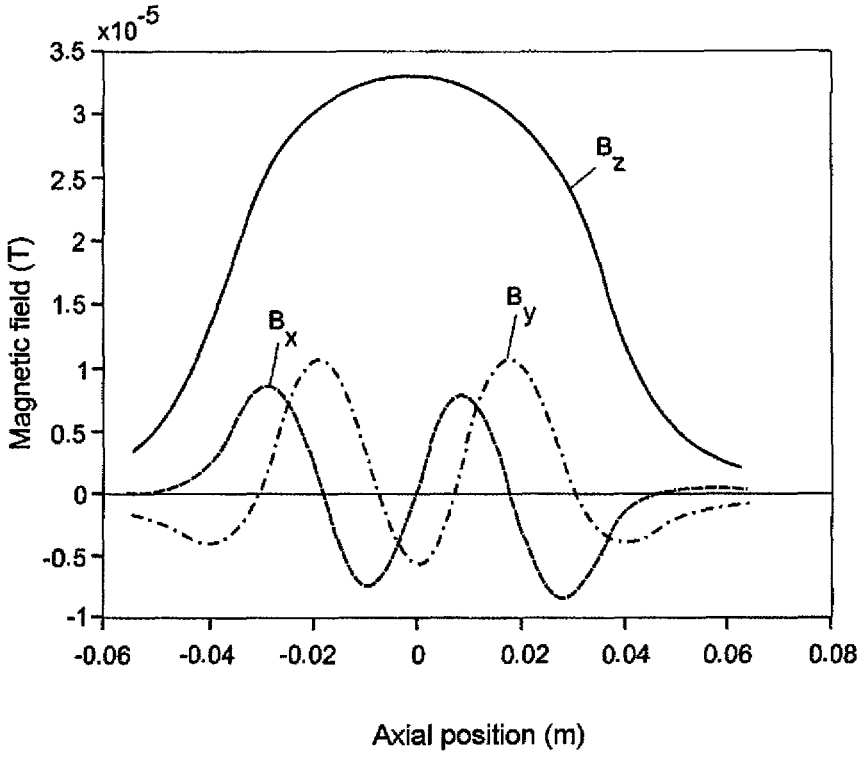
FIG. 7 shows an illustration of the magnetic field as a function of the axial position of a discharge vessel with two turns of the winding part.

According to various embodiments, the feedback supply lead is equipped with at most 1.25 turns. The return path therefore has two straight end parts and a winding part therebetween. For given straight end parts, the axial length of the winding part can therefore be optimized to the effect that the magnetic field By in the middle between the electrodes vanishes, see FIG. 2. Here, the current has been arbitrarily normalized to 1 ampere. The calculations with reference to the optimum geometry are independent of this arbitrary choice. It can be seen that the magnetic field By vanishes in the middle of the arc, but falls off again on both sides of the center. However, it is the integral of the magnetic field between the electrodes that is decisive for the deflection. Consequently, the filament height H(Bavg=0) has be optimized to the effect that the integral of the magnetic field By over the electrode distance vanishes. For the purpose of comparison, the relationships in the case of a winding part with two turns is illustrated in FIG. 7, the three components Bx, By, Bz being specified. In the middle of the winding part, the magnetic field is reduced by only 53%, while the integral of the magnetic field along the electrode distance is reduced to 24%, compared to FIG. 7 by contrast with FIG. 2.

The result is illustrated in FIG. 3. Here, the optimum filament height is illustrated for various filament radii R. The latter are bounded essentially by the outer bulb used. Also specified were the tolerances for the filament height in the case of which the magnetic field of a straight conductor does not vanish, but is reduced to 10% or 30% of a straight conductor. It emerges that given a radius of 20 mm the filament height H can be between 21 and 28 mm (10% Bw) or between 15 mm and 35 mm (30% Bw). This geometry is therefore very tolerant as regards deviations in the fabrication. Smaller radii than 10 mm imply compact burners of low power consumption in the case of which the lamp current is considerably smaller, for example HCI-T 150 W with a lamp current of 1.8 A and outer bulb outside diameter of 24.8 mm. For large radii, H(Bavg=0)/R converges to the asymptote of 0.6256.

FIG. 4 shows in addition the filament height from which the magnetic field in the middle between the electrodes vanishes: H(By=0). Since the optimum filament height scales approximately with the radius, the quotient H/R was also calculated.

An arrangement may be provided in which the straight end parts reach at least into the discharge volume up to the tips of the electrodes.

The relationship $0 \leq H/R \leq 2.5$ may advantageously hold for the axial length H of the winding part and the radius of the winding part, $$0.35 \leq H/R \leq 2.4$$

preferably holding, in particular.

The outer bulb advantageously has an outside diameter of at most 70 mm. In various embodiments, the operating current in the lamp may be at least 1.7 amps.

Particularly high light yields can be attained with a fill that includes at least 2 percent by weight of CeI3 as metal halide.

The color dispersion and length dependence are reduced particularly effectively when the ceramic discharge vessel is cylindrical and has rounded end pieces.

TABLE 1

| R wire | Position | ul/ V | uls/ V | pl/ W | Φ/ klm | η/ lm/W | tn/ K | dc/ .001 | Ra | R9 | uls/ ul | σ(ul)/ V | σ(tn)/ K |
|---|---|---|---|---|---|---|---|---|---|---|---|---|---|
| Filament | V | 111 | 183 | 401 | 41.9 | 105 | 4153 | −1.7 | 96 | 89 | 1.64 | 3.3 | 45 |
| Filament | H | 115 | 189 | 402 | 42.5 | 106 | 4158 | −3.0 | 93 | 79 | 1.64 | 6.8 | 24 |
| Straight | V | 117 | 196 | 402 | 39.5 | 98 | 3990 | −0.7 | 97 | 95 | 1.68 | 4.1 | 46 |
| Straight | H | 118 | 192 | 407 | 45.0 | 111 | 4229 | −3.5 | 94 | 79 | 1.62 | 4.2 | 48 |

In the considered interval between R=10 mm and 30 mm, the quotients H(By=0)/R are between 1.07 and 0.92, and the quotients H(Bavg=0)/R are between 1.79 and 1.01. The quotient can be described very well with the equation $H(Bavg=0)/R=5.64*R^{-0.514}$, see FIG. 4. H(Bavg=0)/R is between 2.5 and 0.58 for the 30% deviation in the B field.

In the exemplary embodiment of a 400 W lamp with metal halide fill, the outside diameter of the outer bulb is 34 mm, and the filament radius R is equal to 14.5 mm. This results in H(Bavg=0) being 20.3 mm. The two straight segments of the supply lead are 47 mm and 28 mm long here. The lamp is illustrated in FIG. 5. Whereas in the case of the conventional geometry the arc is visibly curved because of the magnetic repulsion, it is straight in the case of the innovation presented. Again, the position of the metal halide condensate reflects this state of affairs in the vertical operating position: whereas the condensate is concentrated in a strongly asymmetric fashion on the side of the supply lead in the case of the conventional design, it is virtually perfectly cylindrically symmetrical in the case of the filament design.

The photometric and electrical data for approximately 100 h are summarized in Table 1 and compared with the conventional design. The light yield is approximately 1 lm/W higher than for the standard. The color location consistency of the two operating positions is considerably better (Δ Tn=8 K as against 240 K, and Δ dc=1.3 as against 2.8). This can be explained by the reduced arc deflection in a horizontal orientation.

A further exemplary embodiment is specified in FIG. 6. Here, the winding part has only half a turn that is, in addition, carried out in a plane transverse to the lamp axis in the middle of the discharge vessel. Here, the magnetic fields of the oppositely situated straight portions of the supply lead compensate one another. The magnetic field of the "half" turn is always perpendicular to the current direction and thus also effects no deflection. This design has the advantage, furthermore, that the half turn is located in the region of the joint between the two halves of the discharge vessel, and reduces the additional optical shading by the wire.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A high pressure discharge lamp, comprising:

a lamp axis, and a two-ended discharge vessel that surrounds a discharge volume, electrodes extending into the discharge volume enveloped by the discharge vessel, and a fill that includes metal halides being accommodated in the discharge volume, two capillaries extending outwards along the lamp axis in a direction opposite the electrodes, the discharge vessel being surrounded by an outer bulb with a base at one end and being held therein by a frame, wherein the frame comprises a short supply lead and a long supply lead, the long supply lead comprising two straight conductors with a winding part therebetween, the winding part executing at most 1.25 turns about the discharge vessel wherein the straight conductors extend from the capillary into the zone that lies between the end of the discharge volume and the tip part of the electrode wherein the straight conductors extend from the end of the discharge vessel up to at least the tip of the adjacent electrode.

2. The high pressure discharge lamp as claimed in claim 1, wherein the winding part executes one turn.

3. The high pressure discharge lamp as claimed in claim 1, wherein the winding part executes at least 0.25 turns.

4. The high pressure discharge lamp as claimed in claim 3, wherein the winding part lies in a plane transverse to the lamp axis.

5. The high pressure discharge lamp as claimed in claim 1, wherein the winding part lies in a plane at an inclination to the lamp axis.

6. The high pressure discharge lamp as claimed in claim 1, wherein it holds for the axial length H and the radius R of the winding part that: $0 \leq H/R \leq 3.0$.

7. The high pressure discharge lamp as claimed in claim 6, wherein it holds for the axial length H and the radius R of the winding part that: $0 \leq H/R \leq 2.5$.

8. The high pressure discharge lamp as claimed in claim 1, wherein it holds for the axial length H and the radius R of the winding part that: $0.35 \leq H/R \leq 2.4$.

9. The high pressure discharge lamp as claimed in claim 1, wherein the outer bulb has an inside diameter of at most 70 mm.

10. The high pressure discharge lamp as claimed in claim 1, wherein the operating current is at least 1.7 A.

11. The high pressure discharge lamp as claimed in claim 1, wherein the fill has as metal halide at least CeI3 in a quantity of 2% by weight.

12. The high pressure discharge lamp as claimed in claim 1, wherein the discharge vessel has a central cylindrical part and two rounded ends.

* * * * *